US008651597B2

(12) United States Patent
Kimura

(10) Patent No.: US 8,651,597 B2
(45) Date of Patent: Feb. 18, 2014

(54) RETRACTING DEVICE AND RETRACTING MAIN BODY USED FOR THE SAME

(75) Inventor: Motohiko Kimura, Fujisawa (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 13/696,178

(22) PCT Filed: Apr. 28, 2011

(86) PCT No.: PCT/JP2011/060368
§ 371 (c)(1),
(2), (4) Date: Jan. 7, 2013

(87) PCT Pub. No.: WO2011/138924
PCT Pub. Date: Nov. 10, 2011

(65) Prior Publication Data

US 2013/0133157 A1 May 30, 2013

(30) Foreign Application Priority Data

May 7, 2010 (JP) ..... 2010-107640

(51) Int. Cl.
*A47B 95/00* (2006.01)

(52) U.S. Cl.
USPC ..... 312/333; 312/319.1

(58) Field of Classification Search
USPC ..... 312/319.1, 333
See application file for complete search history.

(56) References Cited

U.S. PATENT DOCUMENTS 5,207,781 A * 5/1993 Rock ..... 312/319.1
5,474,375 A * 12/1995 Hollenstein et al. ..... 312/319.1
7,374,260 B2 * 5/2008 Lu ..... 312/333
7,748,800 B2 * 7/2010 Compagnucci ..... 312/333
7,980,640 B2 * 7/2011 Yang ..... 312/333
8,132,873 B2 * 3/2012 Yang ..... 312/333
2007/0114896 A1 * 5/2007 Orita ..... 312/334.14
2007/0188060 A1 * 8/2007 Nussbaumer et al. ..... 312/333

FOREIGN PATENT DOCUMENTS

JP H06-339414 A 12/1994
JP 2005-230468 A 9/2005
JP 3126876 U 11/2006
JP 3139097 U 1/2008
JP 2008-229281 A 10/2008

OTHER PUBLICATIONS

PCT, "International Search Report for PCT/JP2011/060368", Aug. 16, 2011.

* cited by examiner

*Primary Examiner* — Hanh V Tran
(74) *Attorney, Agent, or Firm* — Manabu Kanesaka

(57) ABSTRACT

A retracting device has a retracting main body including a case, a hook disposed in the case, an urging member, and a braking device including a cylinder and a piston rod; and a protruding portion engaging with and disengaging from the hook in a middle of a movement of a moving body relative to an enclosure. The hook is switched between a retracting position allowing the moving body to move in an engaged state with the protruding portion, and a standby position disallowing the moving body to move in a disengaged state. The hook is in the standby position when disengaged from the protruding portion in a state wherein the piston rod is entered with respect to the cylinder, and has reduced a protruding dimension, and is switchable to the retracting position from the standby position when the piston rod increases the protruding dimension relative to the cylinder.

8 Claims, 10 Drawing Sheets

RETRACTING DEVICE AND RETRACTING MAIN BODY USED FOR THE SAME

FIELD OF TECHNOLOGY

The present invention relates to especially a retracting device which can put a brake on a moving body by a braking device so as not to move rapidly among retracting devices assisting a moving operation of the moving body relative to an enclosure by an urging force, and a retracting main body used for the same.

BACKGROUND ART

FIG. 11(*a*) and FIG. 11(*c*) show a drawer guide tool disclosed in Patent Document 1. The drawer guide tool comprises a guide rail 10 fixed to the enclosure and the like wherein a drawer is housed; and a movable rail 20 connected to the drawer, and provided so as to move along the guide rail 10. The movable rail 20 slides and moves in an open direction when the drawer is pulled out in the open direction. When the drawer is pushed in a closing direction, the movable rail 20 slides and moves in the closing direction. Also, in the movable rail 20, there is provided a protruding portion (a protruding piece) 21. Also, the drawer guide tool includes a casing 40, a hook (a receiving tool) 50 disposed in the casing 40, an urging spring 60, and a shock absorber 30. The shock absorber 30 is the braking device, and comprises a cylinder 31 fixed into the casing 40, and a piston rod 33. In the casing 40, there is formed a guide groove comprising a straight groove 41*a* and a locking groove 41*b* wherein an end portion of the straight groove 41*a* is bent. The hook 50 includes protrusions 51*a* and 51*b* which fit into the guide groove 41; a concave portion 52 engaging with and disengaging from the protruding portion 21; and a joint portion 53. Then, in the joint portion 53 of the hook 50, the hook 50 is pivotally supported turnably at an end portion of the piston rod 33 of the shock absorber 30. The urging spring 60 is a tension spring, and one end is locked in a corresponding portion of the hook 50, and the other end is locked in an immobile state.

As shown in FIG. 11(*b*), the drawer guide tool disclosed in the Patent Document 1 moves the protruding portion 21 toward the hook 50 of the drawer guide tool by a closing operation of the drawer which is the moving body. Then, the protruding portion 21 hits against a back side of the concave portion 52 and engages with the concave portion 52 accompanied by the turning of the hook 50 in a counterclockwise direction. Due to the turning thereof, the protrusion 51*b* is disengaged from the locking groove 41*b*, and the hook 50 is fitted into the straight groove 41*a*, and is switched from a standby position to a retracting position. In the structure, when the hook 50 comes to the retracting position, in a state engaged with the protruding portion 21 on a drawer side, as shown in FIG. 11(*c*), due to an urging force of the urging spring 60, a back side of the casing 40, i.e., the moving body is slid in the closing direction so as to retract the drawer. Also, from this state, due to an open operation of the drawer, the protruding portion 21 is slid to a front side of the casing 40 together with the hook 50 so as to accumulate the urging force in the urging spring 60. When the drawer is operated to open further, the protrusion 51*b* is moved to the locking groove 41*b* from the straight groove 41*a* so as to be engaged, and the hook 50 is switched to the standby position in FIG. 11(*b*).

Incidentally, a closure device for a drawer case disclosed in Patent Document 2 differs from the drawer guide tool disclosed in the Patent Document 1, and a device main body is attached to the drawer case. Also, in the closure device for the drawer case, there is placed a protruding portion (a protrusion) 21, engaging with and disengaging from a hook (a pivot lever) of the device main body in the middle of a movement of the drawer case, on a housing space side of the enclosure.

PRIOR ART DOCUMENTS

Patent Documents

Patent Document 1: Japanese Unexamined Patent Publication No. 2005-230468

Patent Document 2: Japanese Unexamined Patent Publication No. H06-339414

SUMMARY OF THE INVENTION

Problems to be Solved by the Invention

In the drawer guide tool disclosed in the Patent Document 1 and the closure device for the drawer case disclosed in the Patent Document 2, for example, when the moving body (the drawer case and the drawer) is operated to close, from the middle of the closing operation, due to the urging force of the urging spring, the moving body is moved up to a final closed position so as to be capable of reliably solving an occurrence of a condition wherein the moving body is not in a completely closed state. Also, in the drawer guide tool disclosed in the Patent Document 1, compared to the closure device for the drawer case disclosed in the Patent Document 2, by providing the braking device, a moving speed of the moving body can be controlled to not rapidly rise so as to be capable of providing a feeling of a high grade. Furthermore, in the drawer guide tool disclosed in the Patent Document 1, a guide tool main body is placed between the housing space of the enclosure, so that even in a state wherein the moving body is pulled out, an appearance does not deteriorate, and also the guide tool main body is difficult to be damaged. Namely, in the closure device for the drawer case disclosed in the Patent Document 2, although the compression spring is used as the urging spring, the device itself is placed on a lateral face of the moving body so as to deteriorate the appearance. Also, in the closure device for the drawer case disclosed in the Patent Document 2, in order to put a brake on the moving speed of the moving body, a piston damper and the like have to be separately embedded, and the protruding portion (the protrusion) is provided in a portion near a doorway inside the enclosure so as to lie in the way in a case of a cleaning and the like by removing the moving body.

In this kind of guide tool, however, while maintaining a retracting amount due to the urging force, it is required that the guide tool is further light, thin, short, and small. Moreover, it is preferred that the housing space of the enclosure is also small as much as possible. However, in the drawer guide tool disclosed in the Patent Document 1, as shown in FIG. 11(*c*), in a state wherein a length of a portion protruding from the cylinder 31 of the piston rod 33 in the shock absorber 30 is shortened, the hook 50 completes a retraction by maintaining the retracting position, and as shown in FIG. 11(*b*), the piston rod 33 moves in the open direction of the moving body, so that the urging force is accumulated in the urging spring 60, and the hook 50 is disengaged from the protruding portion 21 so as to be switched to the standby position. Consequently, in the guide tool, to explain with an example in which the protruding portion 21 is placed on a back face of the moving body, as shown in FIG. 11(*c*), in a state wherein the moving body is retracted up to the end by the hook 50 and the urging spring 60, regarding the housing space of the enclosure, at the back of the hook 50, i.e., on the left side of FIG. 11(*c*), it is necessary to have a portion of a dimension between the hook 50 and a back end (the left side in FIG. 11(*c*)) of the casing, so that downsizing the enclosure is sacrificed. Also, when the protruding portion 21 is provided in the enclosure of the drawer case, the hook 50 protrudes from a lateral face of the drawer case which is the moving body, so that there is a problem that the appearance is impaired, and also that an object is caught on the hook 50.

Therefore, as the retracting device retracting the moving body from the middle of the movement by the urging force, an object of the present invention is to provide a retracting device which can reduce the housing space on an enclosure side further by making the device itself more light, thin, short, and small while maintaining the retracting amount of the moving body by the urging force, especially, even in a case wherein the braking device is provided together with the urging member.

Means for Solving the Problems

As for an object of solving the aforementioned problem, the present invention provides a retracting device including each characteristic of the following (1) to (6).

(1) The retracting device comprises a retracting main body disposed in a case placed on an enclosure side, and including a hook, an urging member, and a braking device; and a protruding portion placed on a moving body side, and engaging with and disengaging from the hook in the middle of a movement of a moving body relative to an enclosure. In the retracting device, the hook is switched between a retracting position which allows the moving body to move in an engagement state with the protruding portion, and a standby position which comes to be immobile in an engagement released state. The braking device comprises a piston damper including a cylinder and a piston rod, and either one of the cylinder or the piston rod is fixed in the case, and the other is slidably disposed and is pivotally supported on an end side to be capable of turning the hook. The hook comes to the aforementioned standby position which is disengaged from the protruding portion in a state wherein a length of a portion protruding from the cylinder in the piston rod goes down so as to reduce a protruding dimension, and when the piston rod increases the protruding dimension relative to the cylinder, the hook is provided so as to be switched from the standby position to the retracting position.

In the above-mentioned present invention, as for the piston damper, it suffices to include the cylinder, and the piston rod which can change a dimension of a portion exposed from the cylinder by protruding or entering with respect to the cylinder by a hydraulic pressure, an air pressure, and the like. For example, the piston damper is called a shock absorber, a hydraulic system, and the like. Also, the "either one of the cylinder or the piston rod is fixed in the case, and the other is slidably disposed" includes not only a composition of, for example, fixing the cylinder in the case, and slidably disposing the piston rod, but also a composition of fixing an end portion of the piston rod in the case, and slidably disposing the cylinder as well.

Incidentally, the enclosure includes, for example, the enclosure which can house a plurality of drawer cases (drawers), and the like. However, the enclosure is not limited to the above, and includes a frame main body for a sliding door, and the like. The moving body is the drawer case (the drawer), the sliding door, and the like, and is not especially limited to the above provided that the moving body is moved in a closing direction and an open direction relative to a housing space of the enclosure. The retracting main body and the protruding portion are attached corresponding to the enclosure and the moving body. Namely, in a case where the retracting main body is attached to the enclosure, the corresponding protruding portion is attached to the moving body. In a case where the protruding portion is attached to the enclosure, the corresponding retracting main body is attached to the moving body. Then, the retracting main body and the protruding portion are mutually engaged when the moving body has moved up to a predetermined movement position (for example, a specific position in the middle when the drawer case is pushed into the enclosure, if the moving body is the drawer case) relative to the enclosure. Then, the moving body is retracted up to a position finally housed in the enclosure by an urging force accumulated in an urging spring.

(2) Also, in the aforementioned (1), in the retracting device, the urging member comprises a compression spring, and is disposed along the piston damper. Also, one end of the urging member is locked on a slidably disposed side among the cylinder and the piston rod, and the other end is immovably locked. Here, the compression spring includes, for example, a coil spring producing an elasticity which attempts to return against a compression or a pressed force. Incidentally, a coil shape of the coil spring is not limited to a usual cylinder shape, and includes a shape whose coil diameter partially differs such as a conical shape, a Japanese hand drum shape, and the like.

(3) Also, in the aforementioned (2), in the retracting device, the compression spring is disposed on an outer circumference of the other slidably disposed side among the cylinder and the piston rod.

(4) Also, in the aforementioned (2), in the retracting device, among the cylinder and the piston rod, there includes a guide axis connected to the other slidably disposed side, and disposed approximately parallel to the piston damper. Also, the compression spring is disposed on an outer circumference of the guide axis.

(5) Also, in the aforementioned (3) or (4), in the retracting device, among the cylinder and the piston rod, the other slidably disposed side is the piston rod, and the piston rod includes an extension rod connected on a coaxial line.

(6) Also, the retracting main body composing any of the retracting device of the aforementioned (1) to (5).

Effect of the Invention

The present invention has the following effect by having each characteristic of the above.

(A) The retracting device having the characteristic of the aforementioned (1) differs from the closure device for the drawer case disclosed in the Patent Document 2, and the like, and the retracting main body is placed on the enclosure side, so that even in a state wherein the moving body has moved in the open direction relative to the enclosure, the retracting main body is difficult to be visible externally. Also, in the retracting device having the characteristic of the aforementioned (1), the retracting main body includes the piston damper comprising the cylinder and the piston rod as the braking device together with the urging member, so that the piston damper can control a moving speed of the moving body not to rapidly rise, and can put a brake on the moving body so as to be capable of providing a feeling of a high grade. Moreover, in the retracting device having the characteristic of the aforementioned (1), since the piston damper is generally long and thin, a dimension in a width direction of the case can be reduced, so that the downsizing can be easily carried out.

(B) Also, in the retracting device having the characteristic of the aforementioned (1), the hook comes to the standby position which disengages from the protruding portion on the moving body side in a sheathed condition of the piston rod (a state wherein the length of the portion protruding from the cylinder comes to be the shortest within given design limits). In a protruded condition of the piston rod (a state wherein the protruding dimension has increased the most within the given design limits), the hook engages with the protruding portion on the moving body side from the standby position, and comes to the retracting position which allows the moving body to move. Consequently, for example, based on an assumption of a case where the protruding portion is placed on a back face of the moving body, with the moving body retracted up to a final position of the enclosure by the hook and the urging member engaged with the protruding portion, regarding the housing space of the enclosure, just a dead space portion required for a back of the hook or the protruding portion can be reduced. Accordingly, the downsizing of the enclosure can be realized. Incidentally, in a case where the protruding portion is placed on a back face side of the moving body, compared to a composition of being provided on a lateral face of the moving body or a movable rail on the moving body side as shown in the Patent Document 1, the retracting device excels in an appearance, and also is difficult to lie in the way.

(C) Also, in the retracting device having the characteristic of the aforementioned (1), the protruding portion is provided at the back of the moving body, so that a problem, that an object is caught on the protruding portion thereof when the moving body is pulled out, or that the appearance is impaired, as in the aforementioned conventional retracting devices, can be solved.

Also, in the retracting device having the characteristic of the aforementioned (2), the compression spring is used for the urging member, so that an actuation of the hook in an condition 1 can be easily implemented. Also, the compression spring is one of a basic type of the coil spring so as to be capable of obtaining it at a moderate price, and also due to the coil spring, the retracting main body can be maintained to be light and thin.

Also, in the retracting device having the characteristic of the aforementioned (3), the compression spring in the retracting device having the characteristic of the aforementioned (2) is disposed on the outer circumference of the piston rod of the piston damper so as to be capable of minimizing a placement space for the urging member, so that the retracting main body can be made lighter, thinner, and more compact. This also applies to a case wherein the end side of the piston rod is fixed in a case side, and wherein the cylinder is slidably disposed.

Also, in the retracting device having the characteristic of the aforementioned (4), the piston rod in the retracting device having the characteristic of the aforementioned (2) includes the guide axis connected to the end side, and disposed approximately parallel to the piston damper. When the compression spring is disposed on the outer circumference of the guide axis thereof, a size of the placement space for the urging member increases more than the retracting device having the characteristic of the aforementioned (3). However, the retracting device having the characteristic of the aforementioned (4) can stabilize the actuation, or can simplify an assembly as well. This also applies to a case wherein the end side of the piston rod is fixed in the case side, and wherein the cylinder is slidably disposed.

Also, in the retracting device having the characteristic of the aforementioned (5), for example, with preparing a variety of extension rods having a different length, the most appropriate extension rod according to a usage or a specification is replenished so as to be capable of expanding a degree of freedom of design.

BRIEF DESCRIPTION OF THE DRAWINGS

FIG. 1(*b*) is a schematic structural view showing a state after the retraction in the example in which the retracting device according to the embodiment of the present invention is used for the drawer mechanism of the drawer body 8 relative to the enclosure.

FIG. 2(*b*) is a side view viewed from a lateral face 11 side in the urging-force accumulated state of the retracting main body 6 of the retracting device according to the first embodiment.

FIG. 2(*c*) is a side view viewed from the lateral face 11 side in a state of a retraction completion of the retracting main body 6 of the retracting device according to the first embodiment.

FIG. 3(*b*) is a drawing viewed from a direction of an arrow wherein a symbol "B" shown in FIG. 1(*a*) is assigned.

FIG. 4(*b*) is a side view separately showing the case 1 of the retracting main body 6, and viewed from the lateral face 10 side.

FIG. 4(*c*) is a side view separately showing the case 1 of the retracting main body 6, and viewed from the lateral face 11 side.

FIG. 4(*d*) is an end view separately showing the case 1 of the retracting main body 6, and viewed from a back end face 13 side.

FIG. 5(*b*) is a side view showing the piston damper 3, the hook 2, and the compression spring (the urging member) 5 forming the retracting main body 6 with the hook 2 in a retracting position.

FIG. 6(*b*) is a schematic exploded view showing the portion assigned with "C" in FIG. 5(*b*) from an angle different from FIG. 6(*a*).

FIG. 7(*b*) is a side view viewed from the lateral face 11 side in the urging-force accumulated state of the retracting main body 6A according to the second embodiment.

FIG. 7(*c*) is a side view viewed from the lateral face 11 side in a state of a retraction completion of the retracting main body 6A according to the second embodiment.

FIG. 8(*b*) is a side view separately showing the case 1A of the retracting main body 6A, and viewed from the lateral face 10 side.

FIG. 8(*c*) is a side view separately showing the case 1A of the retracting main body 6A, and viewed from the lateral face 11 side.

FIG. 8(*d*) is an end view separately showing the case 1A of the retracting main body 6A, and viewed from the back end face 13 side.

FIG. 9(*b*) is a side view showing the piston damper 3, the hook 2, and the compression spring (the urging member) 5, forming the retracting main body 6A, with the piston rod 32 in a protruding state.

FIG. 10(*b*) is a schematic exploded view showing a portion shown in FIG. 9(*b*) assigned with a symbol "E".

FIG. 11(*b*) is a schematic diagram in a state wherein a retracting main body in the drawer guide tool disclosed in the Patent Document 1 is in a standby position of a hook.

FIG. 11(*c*) is a schematic diagram in a state wherein the retracting main body in the drawer guide tool disclosed in the Patent Document 1 is in a retracting position of the hook.

BEST MODES OF CARRYING OUT THE INVENTION

Figure 1A:
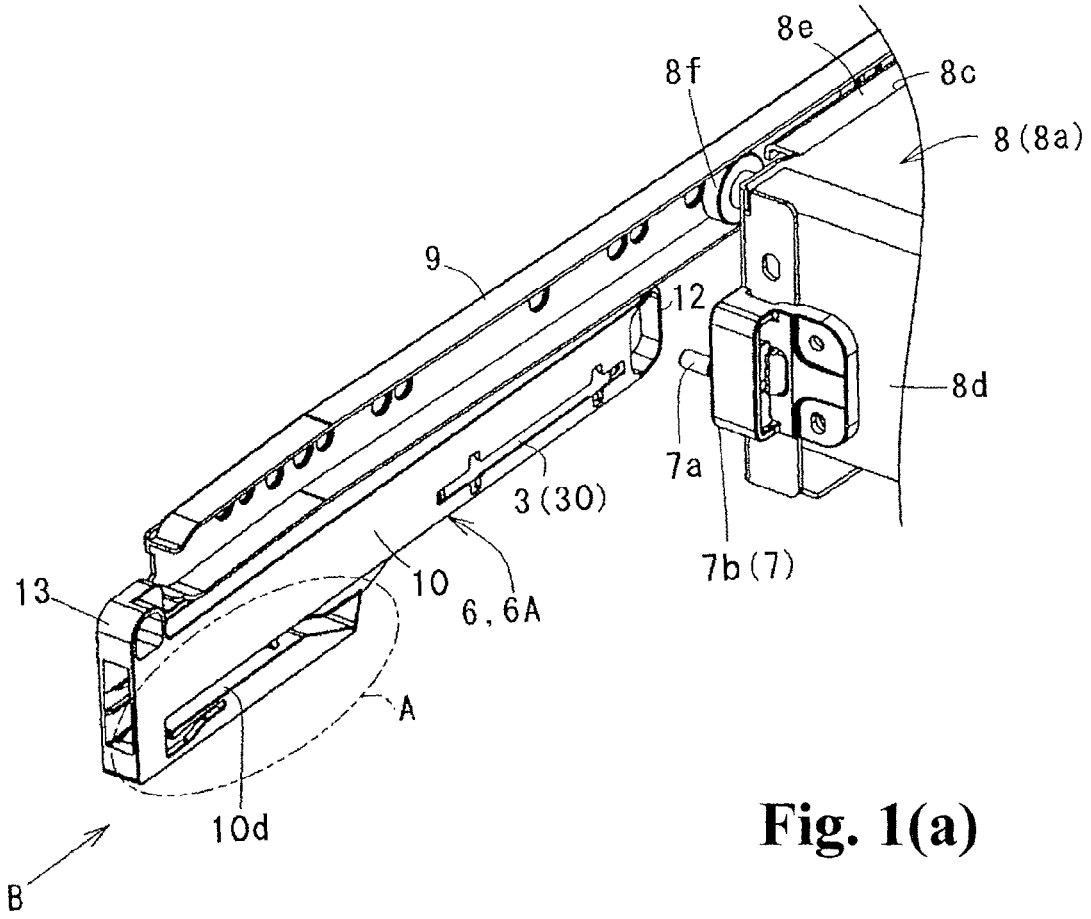
FIG. 1(*a*) is a schematic structural view showing a state before a retraction in an example in which a retracting device according to an embodiment of the present invention is used for a drawer mechanism of a drawer body 8 relative to an enclosure.
Figure 1B:
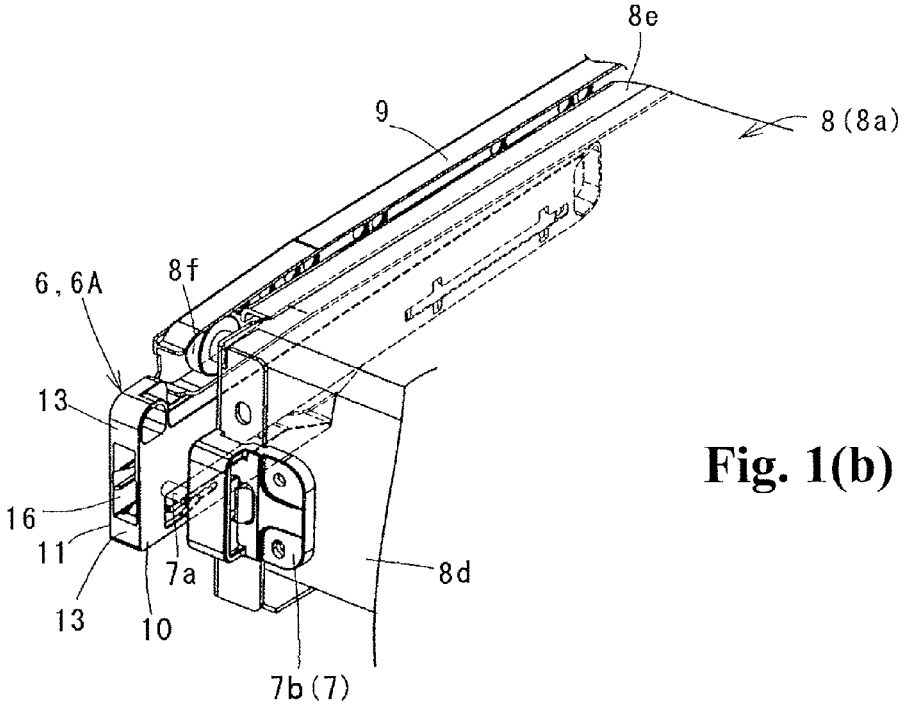

A retracting device according to an embodiment of the present invention will be explained with reference to drawings. FIG. 1(*a*) to FIG. 6(*b*) show a retracting device according to the first embodiment, and FIG. 7(*a*) to FIG. 10(*b*) show the retracting device according to a second embodiment. Incidentally, in each figure, one portion is omitted or simplified for constructing the figure. In the hereinafter-described explanation, a device characteristic of each embodiment, a retracting main body 6 which the retracting device of the first embodiment comprises, and a retracting main body 6A which the retracting device of the second embodiment comprises will be described in detail in that order.

(Device Characteristic of Each Embodiment)

Both the retracting devices according to the first embodiment and the second embodiment of the present invention are preferably used for, for example, an in-and-out mechanism of a drawer body 8 in an enclosure wherein the drawer body 8 is housed inside a housing space to be capable of being taken in and out, and the like. More specifically, the retracting device of the present embodiment comprises the retracting main bodies 6 and 6A, and an engaged device 7. As shown in FIG. 1(*a*) and FIG. 1(*b*), in a case of being used for the enclosure wherein the drawer body 8 can be taken in and out along a guide rail 9 attached to a wall surface of the housing space and the like, the retracting main bodies 6 and 6A are attached to, for example, the guide rail 9 or the housing space, and the engaged device 7 is attached to, for example, the drawer body 8. Incidentally, the drawer body 8 is one example of a moving body, and is the same as one generally called a "drawer case" or a "drawer". Also, the later-described protruding member 7*a* in the engaged device 7 is one example of a protruding portion in the retracting device of the present invention. Also, as shown in FIG. 1(*a*) and FIG. 1(*b*), the reference numeral 8*a* represents a back side portion of the drawer body 8, the reference numeral 8*b* represents an upper face, the reference numeral 8*c* represents a lateral face, the reference numeral 8*d* represents a back face, the reference numeral 8*e* represents a guide frame attached on the lateral face 8*c*, and the reference numeral 8*f* represents a roller which is fixed in the guide frame 8*e* and moves while rotating along the guide rail 9. The guide rail 9 is attached to, for example, an outside face of the enclosure so that a longitudinal direction thereof becomes horizontal. In the guide rail 9, a shape of a cross-sectional surface (a vertical cross-sectional surface) orthogonal to the aforementioned longitudinal direction has an approximately C shape, and a lateral face of the roller 8*f* abuts against an upper face and a lower face inside the approximately C shape. Then, the roller 8*f* is guided along the longitudinal direction of the guide rail 9, so that the drawer body 8 can smoothly move in an open direction or a closing direction. Incidentally, the above-mentioned guide structure is respectively provided on both inner sides of the housing space of the drawer body 8 in the enclosure. Namely, while the roller 8*f* respectively provided on both sides of the drawer body 8 is rotating, the drawer body 8 is guided by the corresponding guide rail 9 so as to move in the open direction or the closing direction.

The retracting main bodies 6 and 6A are the same in that the retracting main bodies 6 and 6A include a case 1 or 1A attached to the guide rail 9 which has been attached to the enclosure or a predetermined portion of the housing space, a hook 2 respectively disposed in the case 1 or 1A, a piston damper 3 as a braking device, and a compression spring 4 as an urging member; in that the piston damper 3 fixes either one of a cylinder 30 or a piston rod 32 to a case 1 or 1A side, and the other of the cylinder 30 or the piston rod 32 is slidably disposed and is pivotally supported at an end side to be capable of turning the hook 2; and in that an engagement of the hook 2 with the protruding member 7*a* composing the engaged device 7 is released in a state wherein the piston rod 32 has entered with respect to the cylinder 30, and has reduced a protruding dimension, so that the hook 2 comes to a standby position which does not allow a movement of the drawer body 8, and in a state wherein the piston rod 32 has increased the protruding dimension relative to the cylinder 30, the hook 2 is switched to a retracting position which allows the drawer body 8 to move in a state of being engaged with the protruding member 7*a* from the aforementioned standby position.

On the other hand, in the engaged device 7, the protruding member 7*a* is supported relative to an attaching base 7*b* to be capable of slightly moving up and down by maintaining an approximately horizontal state through a holding member, an urging spring, and the like which are not shown in the figures. The structure is mechanistically the same as, for example, a structure especially shown in FIGS. 13 and 14 in Japanese Unexamined Patent Publication No. 2009-203620 (refer to paragraphs 0025 to 0038 of the same Publication). In the aforementioned engaged device 7, in a state wherein the base 7*b* is fixed to the back face 8*d* of the drawer body by a screw and the like which are not shown in the figures, the protruding member 7*a* is disposed to protrude to a lower side of the guide rail 9 rather than the corresponding lateral face 8*c*, i.e., in a transverse direction. Obviously, as for the engaged device 7 or the protruding member 7*a*, it is only necessary to be engaged with and disengaged from the hook 2 of the retracting main bodies 6 and 6A, and the engaged device 7 or the protruding member 7*a* may also have a structure besides the above.

(Retracting Main Body 6)

As shown in FIG. 1(*a*) to FIG. 4(*d*), the retracting main body 6, which the retracting device according to the first embodiment of the present invention comprises, has a composition in which each member is integrally embedded inside the case 1 in a state wherein the hook 2 and a compression spring 5 are respectively placed on a corresponding portion of the piston damper 3 relative to the case 1.

Here, as shown in FIG. 1(*a*) and FIG. 1(*b*), the case 1 has an external form which is elongated in a front and back direction, and includes lateral faces 10 and 11, a front end face 12, a back end face 13, an upper face 14, and a lower face 15. In an inside thereof, there is formed an internal space 16 which is divided by the aforementioned respective face. Nearer the back end face 13 in the upper face 14, there is projected a positioning piece portion 14*a*. In a front portion and a back portion of the case 1, there are provided attachment holes 17*a* and 17*b* in such a way as to pass through the lateral faces 10 and 11. The internal space 16 is communicated with an outside in a front end face 12 side and a back end face 13 side, and also is communicated with the outside through a window, a concave portion, and the like provided in the respective lateral faces 10 and 11 as described later.

As shown in FIG. 4(*a*) to FIG. 4(*c*), in one lateral face 10, there are provided a window 10*c* extending in a front direction from an approximately middle of front and back; a notch portion 10*b* positioned on a lower side of the window 10*c*, and linearly notched until just before a back end from a front end so as to allow the protruding member 7*a* to be introduced up to a back side of the internal space 16; a concaved guide groove 10*d* which composes a back side portion of the notch portion 10*b*, and moves and guides the protruding member 7*a*; a downwardly-sloping escape groove 10*e* which has notched a front side of the guide groove 10*d* up to a lower face side; and an elastically-imparting escape groove 10*f* which has notched a back side of the guide groove 10*d* in an approximately L shape. Incidentally, the reference numeral 10*a* represents an inner face of the lateral face 10. As shown in FIG. 4(*c*), in the inner face 10*a*, there are provided a locking portion 10*h* located on a front end of the later-mentioned guide groove 19, and which has a vertically long concave shape; and a guide groove 18*a* and a guide groove 19*a* which have a concave shape, and face the later-mentioned linearly two-tiered guide groove 18 and guide groove 19. The locking portion 10*h* is connected to the guide groove 19*a*.

On the other lateral face 11, there are provided a concave place 11*b* for housing the cylinder in which a portion just before a front end rather than an approximately middle of front and back is notched; a rib 11*e* dividing an upper side of the concave place 11*b*; a concave place 11*c* for housing the piston rod and the like in which portions on an upper side of the rib 11*e* and slightly on a back side rather than the middle of the front and back of the lateral face 11 are notched; the linear guide groove 18 notched from the back side of the concave place 11*c* till the back end 13; and the guide groove 19 notched from a lower side of a back end 11*d* of the concave place 11*c* till the back end 13, and which is parallel to the guide groove 18. The reference numeral 11*f* represents a pair of ribs provided on the back side of the concave place 11*b*, and edging an entrance leading to the concave place 11*c*. The reference numeral 11*g* represents a plurality of locking claws for retaining the cylinder which is provided to protrude by facing upper and lower sides of the concave place 11*b*. The back end 11*d* of the concave place 11*c* is overlapped with the locking portion 10*h* by disposing the internal space 16 in between, and a portion just before the guide groove 19, i.e., a lower side of the guide groove 19 is set in a locking portion 11*h*. The locking portion 11*h* controls protrusions 24 of the later-mentioned hook 2 to engage between the locking portion 11*h* and the locking portion 10*h*. Incidentally, the reference numeral 11*a* represents an inner face of the lateral face 11. Also, the case 1 may be formed as a united component by, for example, carrying out a mold injection to resin. Not only as the above, the case 1 may be composed by a case main body and a cover.

Figure 5A:
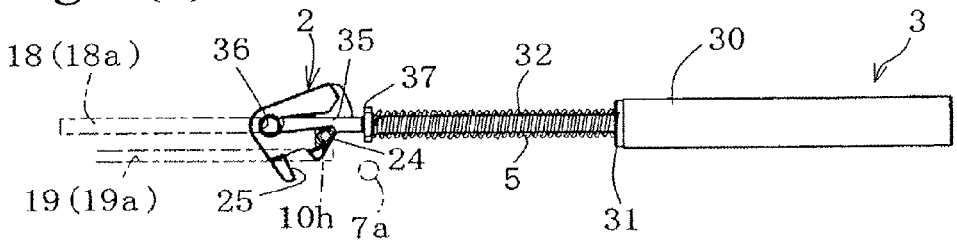
FIG. 5(*a*) is a side view showing a piston damper 3, a hook 2, and a compression spring (an urging member) 5 forming the retracting main body 6 with the hook 2 in a standby position.
Figure 5B:
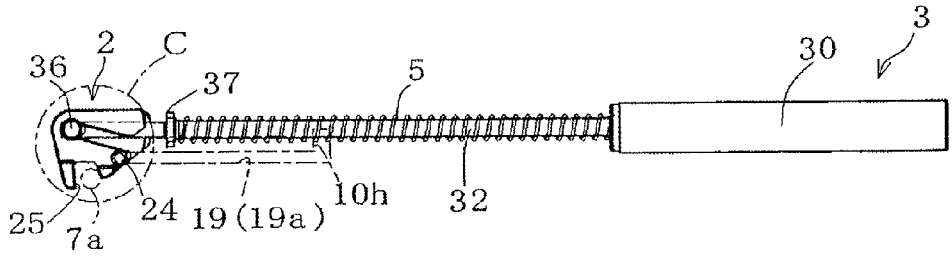

As shown in FIGS. 5(*a*) and 5(*b*), in the piston damper 3, a cylinder mechanism itself is heretofore known (especially, a tensile type), and the piston damper 3 includes the cylinder 30, and the piston rod 32 disposed so as to gently protrude and enter with respect to the cylinder 30. In a doorway of the cylinder 30, there is placed a cap 31. In the piston damper 3 of the present example, the piston rod 32 drives to gently protrude and enter with respect to the cylinder 30 which has been fixed. Incidentally, in place of the above, the piston damper 3 may have a composition wherein the cylinder 30 gently drives relative to the piston rod 32 whose end is fixed. Also, in the example, an extension rod 35 is connected to the piston rod 32, and the hook 2 is pivotally supported in the extension rod 35 turnably.

The extension rod 35 is connected to the end of the piston rod 32 by screwing (not shown in the figures) or by another joint structure (for example, the later-mentioned structure in FIG. 10(*a*)), and also an end of the extension rod 35 is formed in an axis portion 36 of a T shape. At that time, the compression spring 5 is disposed on an outer circumference of the piston rod 32. The compression spring 5 is a coil-winding type with the same radius, and one end is locked in the cap 31 on a cylinder side, and the other end is locked in a flange portion 37 provided in a joint portion of the extension rod 35.

Figure 2A:
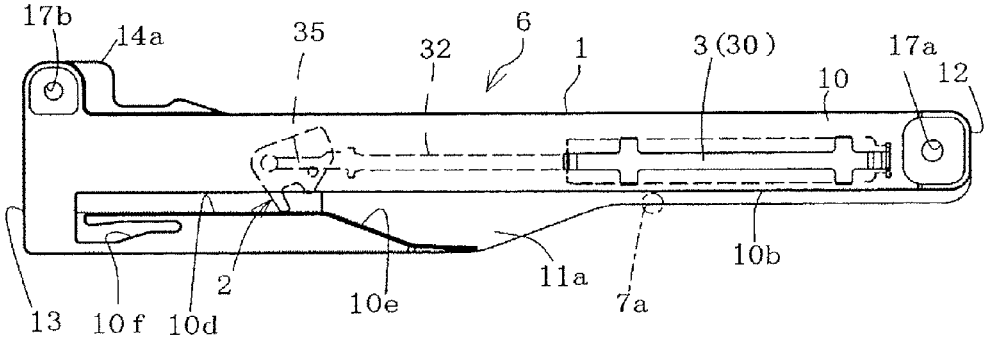
FIG. 2(*a*) is a side view viewed from a lateral face 10 side in an urging-force accumulated state of a retracting main body 6 of the retracting device according to the first embodiment.
Figure 2B:
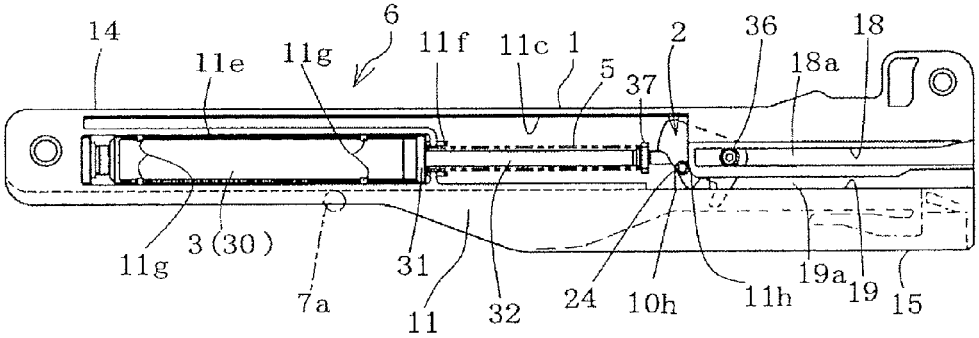
Figure 2C:
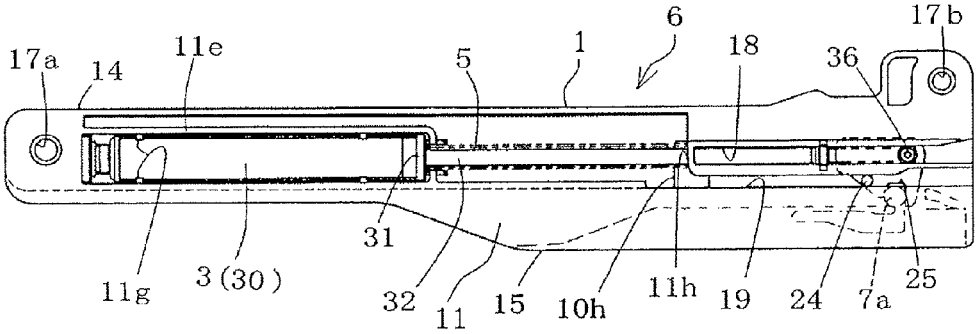
Figure 3A:
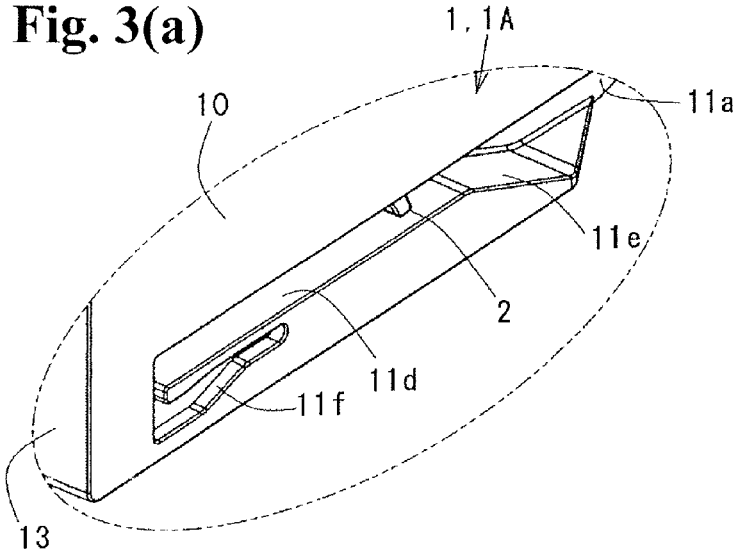
FIG. 3(*a*) is an enlarged view of a portion wherein a symbol "A" shown in FIG. 1(*a*) is assigned.
Figure 3B:
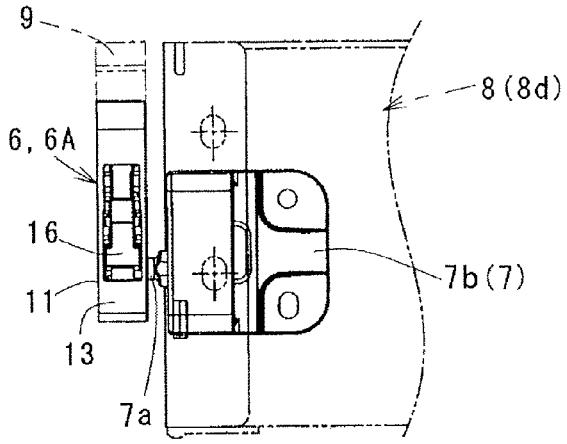
Figure 4A:
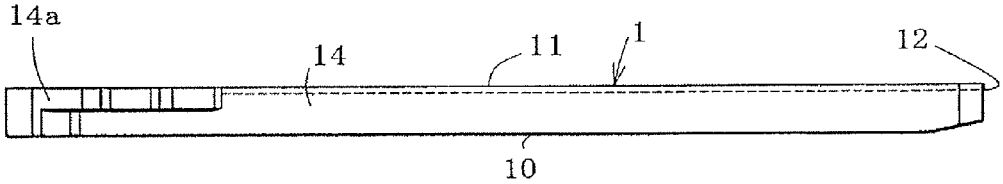
FIG. 4(*a*) is a plan view showing a case 1 of the retracting main body 6 as a separate component.
Figure 4B:
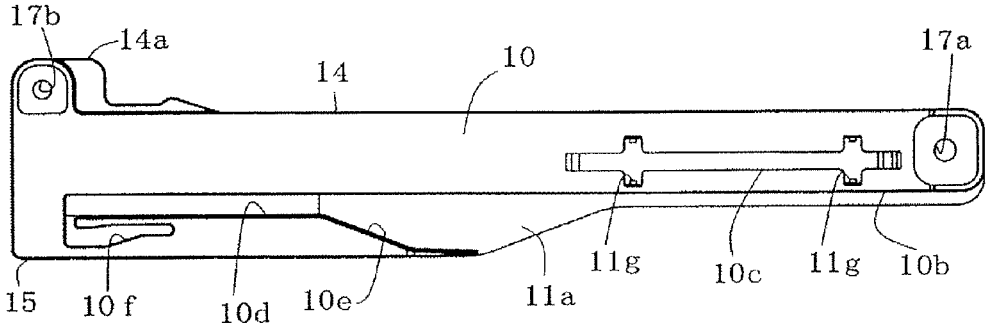
Figure 4C:
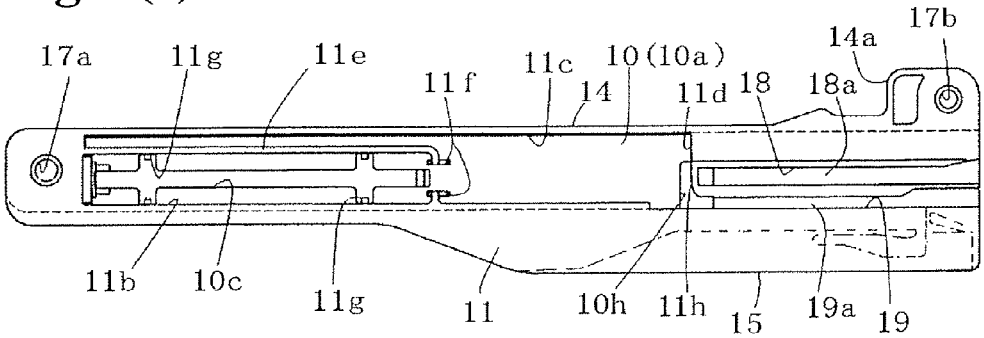
Figure 4D:
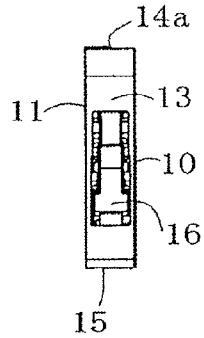
Figure 6A:
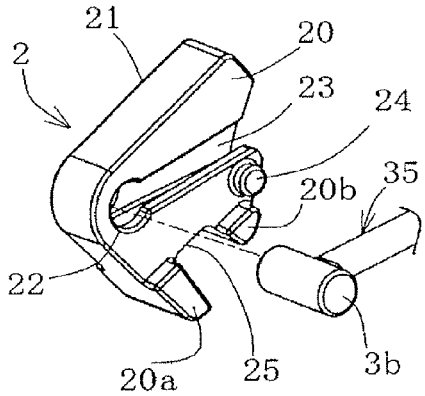
FIG. 6(*a*) is a schematic exploded view showing a portion assigned with "C" in FIG. 5(*b*).
Figure 6B:
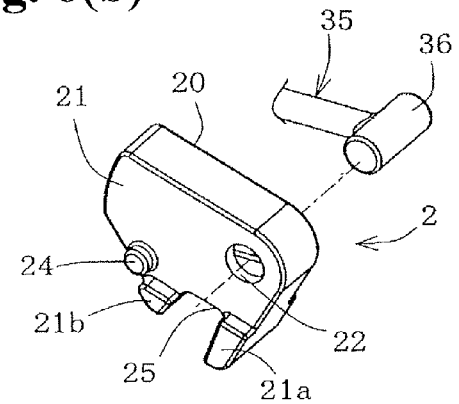

The hook 2 is housed in the internal space 16 of the case 1, and slides in the internal space 16 of the case 1 in the front and back direction along the guide grooves 18 and 19. As shown in FIGS. 6(*a*) and 6(*b*), the hook 2 of the present example includes an engagement hole 22 provided on an end side of the case 1, and passing through both lateral faces 20 and 21; an engagement groove 23 provided on one lateral face, and leading to the engagement hole 22 from a back side; the protrusions 24 located on a back side of both the lateral faces 20 and 21, and provided to protrude on a coaxial line; and a concave portion 25 provided on a front end face, and engaging with and disengaging from the aforementioned protruding member 7*a*. Also, in both the lateral faces 20 and 21, there are provided projecting portions 20*a* and 20*b*, and 21*a* and 21*b* in front and back portions which divide the concave portion 25. The engagement groove 23 is formed with a central focus on the engagement hole 22, and a groove width on the back side is formed wider than a radius of the extension rod 35. As shown in FIG. 2(*b*) and FIG. 2(*c*), the protrusions 24 on both sides are slidably fitted in the guide groove 19 and the guide groove 19*a* provided in the case 1, and positions of the protrusions 24 are controlled by the locking portion 11*h* and the locking portion 10*h* so as to be locked.

An end axis side of the extension rod 35 is fitted in the engagement groove 23, and the axis portion 36 of the end is engaged with the engagement hole 22, so that the above-mentioned hook 2 is pivotally supported relative to the extension rod 35 turnably only for a predetermined angle with a central focus on the axis portion 36. The predetermined angle is set in a groove width of the engagement groove 23, and is an angle switchable between the retracting position (FIG. 2(*c*)) which allows the moving body to move in a state wherein the hook 2 is engaged with the protruding member 7*a*, and the standby position (FIG. 2(*b*)) which comes to be immobile in a state wherein the aforementioned engagement is released.

Also, although the piston damper 3 is embedded in the case 1 as mentioned above from a state wherein the compression spring 5, the extension rod 35, and the hook 2 are assembled, an assembling procedure is not limited to the above, and is optional. In assembled states shown in FIG. 2(*a*) and FIG. 2(*c*), the cylinder 30 is retained by the plurality of locking claws 11*g* in a state of being disposed in the concave place 11*b*. The piston rod 32 and the compression spring 5 can protrude toward the internal space 16 on a backward side from the concave place 11*c*. The axis portion 36 of the extension rod is slidably fitted in the guide grooves 18 and 18*a* to which both ends of the axis portion 36 protruding from the engagement hole 22 of the hook 2 correspond. The hook 2 is embedded switchably between the retracting position, as shown in FIG. 2(*c*), in which each protrusion 24 on both lateral faces is slidably fitted in the corresponding guide grooves 19 and 19*a* of the case 1, and the standby position, as shown in FIG. 2(*b*), in which each protrusion 24 is engaged with the locking portion 11*h* and the locking portion 10*h* so as to be locked in an immobile state.

(Usage Example)

FIG. 1(*a*) and FIG. 1(*b*) are one example wherein the above-mentioned retracting device is applied to a retraction of the drawer body 8. In this disposition, the retracting main body 6 is placed on the guide rail 9 disposed inside a housing portion of the enclosure, and also the aforementioned engaged device 7 is attached to the back face 8*d* of the drawer body 8. In that case, the retracting main body 6 is firmly fixed to a back side of the guide rail 9. The attaching base 7*b* of the engaged device 7 is positioned so as to protrude from the lateral face 8*c* of the drawer body in such a way that the protruding member 7*a* is moved along a line of the notch portion 10*b* of the retracting main body 6 and the guide groove 10*d*. Incidentally, usually, the retracting device has a composition of retracting the drawer body 8 by using a pair of the retracting main body 6 and the engaged device 7, and another pair of the retracting main body 6 and the engaged device 7 is bilaterally symmetric relative to the retracting main body 6 and the engaged device 7 shown in FIG. 1(*a*) and FIG. 1(*b*).

(Actuation)

An actuation of the retracting device of the present embodiment explained in the above will be described in detail with reference to FIG. 1(*a*), FIG. 1(*b*), FIG. 2(*a*), FIG. 2(*b*), FIG. 2(*c*), FIG. 5(*a*), and FIG. 5(*b*).

(1) First, an actuation characteristic of the retracting main body 6 is that the hook 2 comes to the standby position in an urging-force accumulated state wherein the compression spring has accumulated an urging force as shown in FIG. 2(*b*), and that the hook 2 comes to the retracting position in an urging-force released state wherein the compression spring 5 has released the urging force as shown in FIG. 2(*c*). In the urging-force accumulated state, the piston rod 32 has entered with respect to the cylinder 30, and has reduced a protruding amount up to the minimum given design limits, and the hook 2 is switched to the standby position, so that a state thereof is maintained. Then, in the structure, in the aforementioned urging-force accumulated state, when the drawer body 8 is operated to move in the closing direction, i.e., to a backward side of the guide rail 9, the protruding member 7*a* also moves along the notch portion 10*b* and the guide groove 10*d* of the retracting main body 6, and abuts against a back side dividing the concave portion 22 of the hook 2. Then, the hook 2 turns in a counterclockwise direction as a supporting point of the axis portion 36 by stress thereof, and due to the turning thereof, the protrusions 24 on both sides release an engagement between the locking portion 11*h* and the locking portion 10*h*. At the same time, in a state wherein the protruding member 7*a* is restrained in the concave portion 22, the hook 2 moves backward along the guide grooves 19 and 19*a* by the urging force of the compression spring 5. Due to the movement thereof, the drawer body 8 is held in a closed state wherein the drawer body 8 has been completely pushed in.

(2) In a case where the drawer body 8 is pulled out again, the drawer body 8 is operated to move in the open direction from a state shown in FIG. 1(*b*) and FIG. 2(*c*). Then, in the retracting device, in the retracting position wherein the hook 2 has engaged with the protruding member 7*a* and has restrained the protruding member 7*a* in the concave portion 25, each protrusion 24 slides along the corresponding guide grooves 19 and 19*a*, and both ends of the axis portion 36 slide along the corresponding guide grooves 18 and 18*a*. In the sliding process, the piston rod 32 enters with respect to the cylinder 30, and reduces the protruding amount, and the compression spring 5 is compressed so as to accumulate the urging force. After that, as shown in FIG. 2(*b*), when each protrusion 24 has reached the locking portions 11*h* and 11*h* from the guide grooves 19 and 19*a*, the hook 2 turns in a clockwise direction as the supporting point of the axis portion 36 by the stress which the hook 2 receives from the protruding member 7*a*, and the protrusions 24 engage with the locking portion 11*h* and the locking portion 10*h* from the retracting position, so that the hook 2 is switched to the standby position which comes to be immobile.

(3) Therefore, for example, as shown in FIG. 1(*b*), the retracting device of the present example can be configured such that the drawer body 8 is retracted up to the most backward side of the housing space of the enclosure by the hook 2 which has been engaged with the protruding member 7*a* and the compression spring 5. Also, as the housing space of the enclosure, a space required for a back of the hook 2 or the protruding member 7*a* can be reduced so as to be capable of downsizing the enclosure, or of controlling the volume of the housing space. Also, since the retracting main body 6 is composed by the case 1, the hook 2, the piston damper 3, the compression spring 5, and the extension rod 4 which is used as necessary, the retracting device of the present example excels in that it is simplified, and can be implemented inexpensively. Also, the compression spring 5 which is a coil spring is used as the urging member, and also the compression spring 5 is disposed on the outer circumference of the piston rod 32 of the piston damper, so that the retracting device of the present example excels in that a placement space for the urging member can be minimized.

(Retracting Main Body 6A)

Figure 7A:
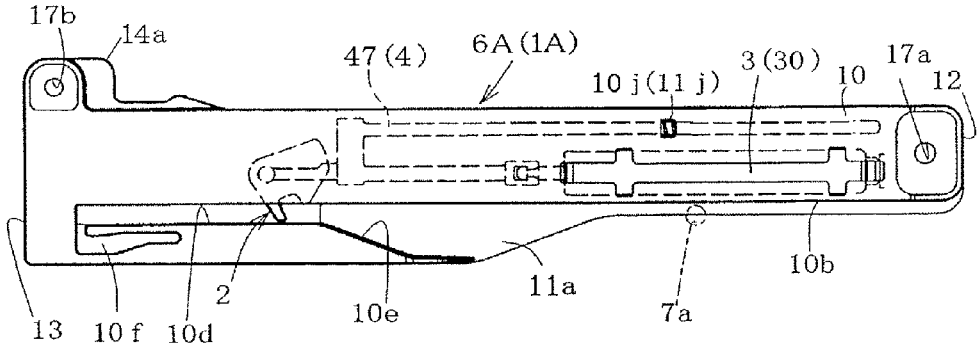
FIG. 7(*a*) is a side view viewed from the lateral face 10 side in an urging-force accumulated state of a retracting main body 6A according to a second embodiment.
Figure 7B:
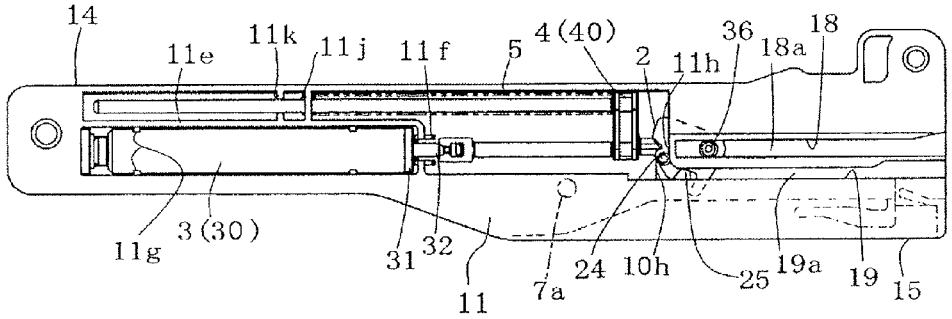
Figure 7C:
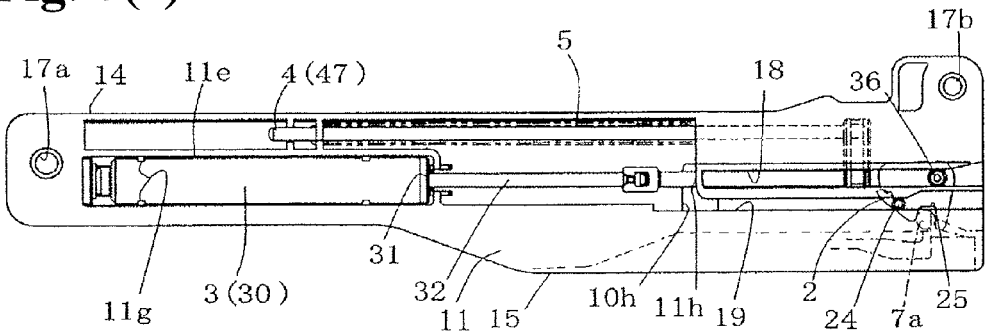
Figure 8A:
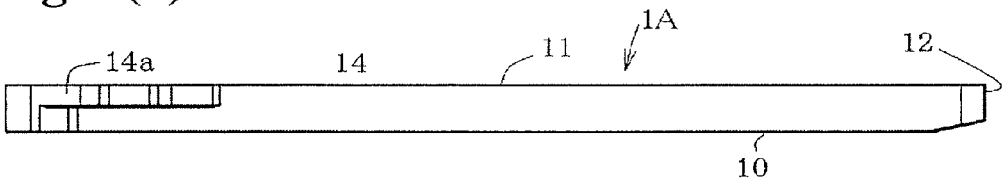
FIG. 8(*a*) is a plan view showing a case 1A of the retracting main body 6A as a separate component.
Figure 8B:
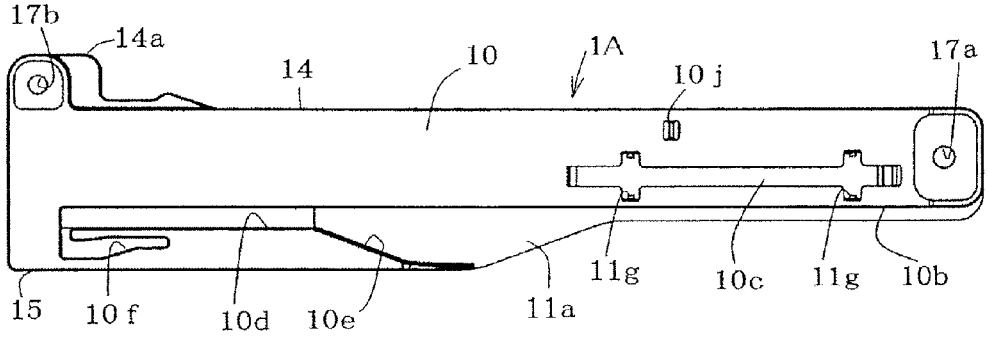
Figure 8C:
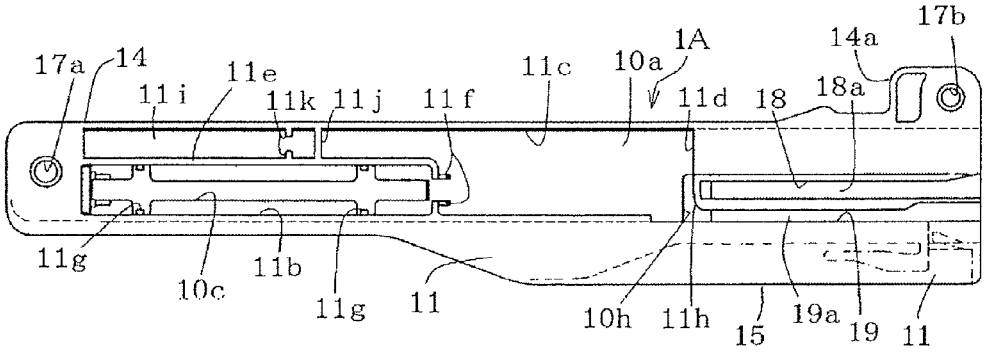
Figure 8D:
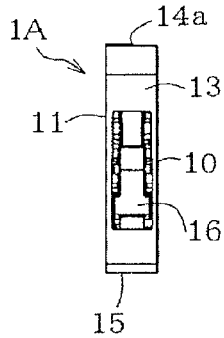
Figure 9A:
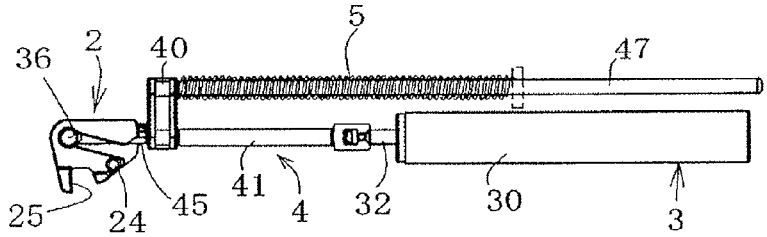
FIG. 9(*a*) is a side view showing the piston damper 3, the hook 2, and the compression spring (the urging member) 5 forming the retracting main body 6A, with a piston rod 32 in an immersive state of a piston rod 32.
Figure 9B:
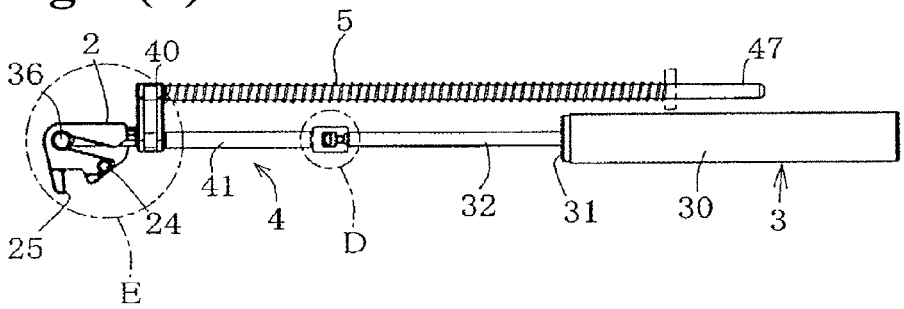
Figure 10A:
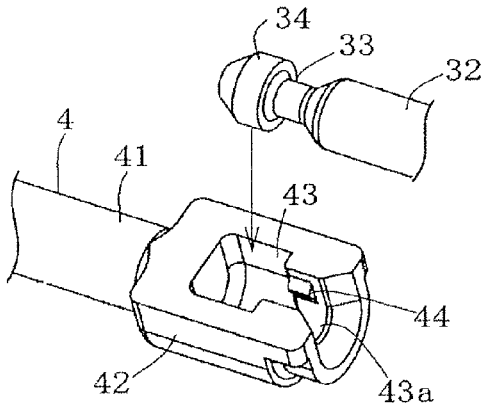
FIG. 10(*a*) is a schematic exploded view showing a portion shown in FIG. 9(*b*) assigned with a symbol "D".
Figure 10B:
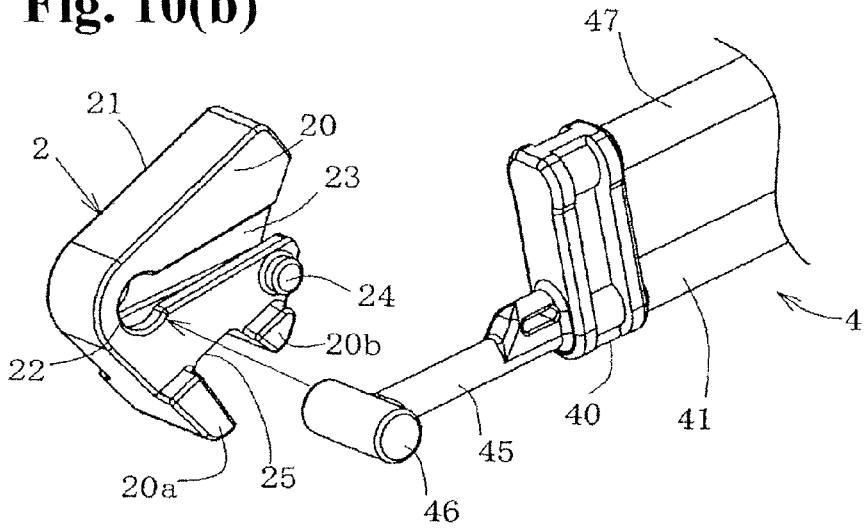
Figure 11A:
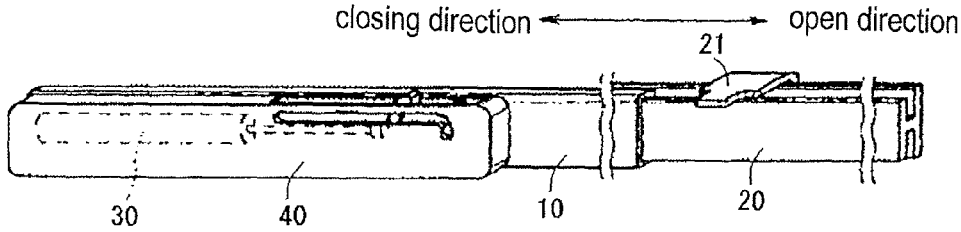
Fig. 11(a) Prior Art
FIG. 11(*a*) is a relationship diagram of a movable rail on a moving body side and a guide rail on an enclosure side in a drawer guide tool disclosed in Patent Document 1.
Figure 11B:
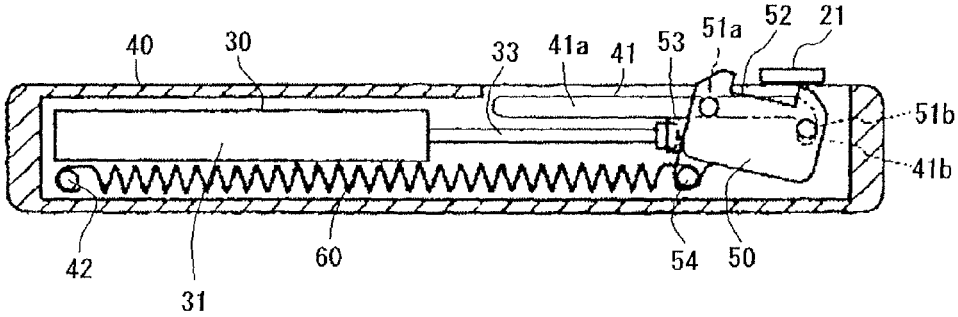
Fig. 11(b) Prior Art
Figure 11C:
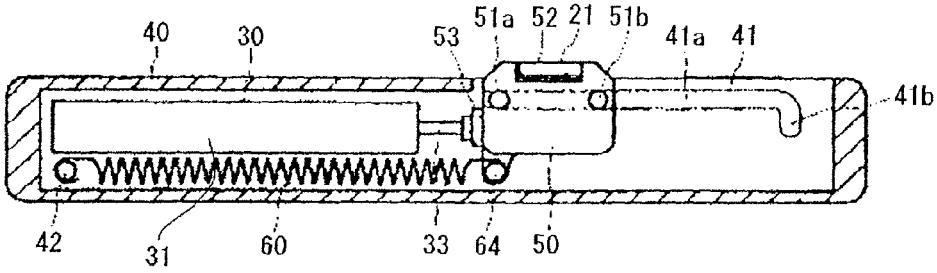
Fig. 11(c) Prior Art

FIG. 7(*a*) and FIG. 10(*b*) show the retracting main body 6A comprised in the retracting device according to the second embodiment of the present invention. In the explanation, the same reference numeral is assigned to the same member and the functionally same portion as the first embodiment, only a modified composition will be clarified, and an overlapped description will be omitted as much as possible. Namely, in the second embodiment, a placement composition of the extension rod 4 and the compression spring 5 is modified relative to the first embodiment. Also, in the case 1A, according to a modification thereof, a width dimension is slightly formed widely.

The extension rod 4 integrally comprises a first rod 41 including a connecting portion 40, and connected to the end of the piston rod 32 by an engagement structure; a second rod 45 provided to stand up in the connecting portion 40, and extending on the coaxial line as the first rod 41, and also forming an end in an axis portion 46 of a T shape; and a support rod 47 whose one end is connected to the connecting portion 40, and which extends approximately parallel to the first rod 41.

As shown in FIG. 10(*a*), the first rod 41 includes a female engagement receiving portion 42 on a base end side, and the engagement receiving portion 42 is connected to a male engagement axis portion 33 provided in the end of the piston rod 32 by an engagement. The engagement receiving portion 42 comprises a concave portion 43; a communicating portion 43*a* on an end side communicated with the concave portion 43; and retaining claws 44 provided to protrude on both upper inner end faces of the communicating portion 43*a*. On the other hand, in the end side of the piston rod 32, there are formed a small diameter neck portion 33 and a large diameter projecting portion 34 in order in the end of the rod. Then, in a state wherein the projecting portion 34 engages with the concave portion 43, and wherein the neck portion 33 is retained and locked in the communicating portion 43*a* through the claws 44, the piston rod 32 is connected relative to the engagement receiving portion 42.

In the second rod 45, as is the case in the extension rod 35 of the first embodiment, the end is formed in the axis portion 46 of the T shape. Then, as is the case in the first embodiment, an end axis side of the extension rod 45 is fitted in the engagement groove 23, and the axis portion 46 of the end is engaged with the engagement hole 22, so that the hook 2 is pivotally supported relative to the extension rod 45 turnably only for a predetermined angle with a central focus on the axis portion 46.

Meanwhile, compared to the aforementioned case 1, in the case 1A, there is widely ensured a space 11*i* between an upper side edge of the rib 11*e* among the rib 11*e* dividing the upper side of the concave place 11*b*, and the concave place 11*c*. Also, the case 1A includes a retaining-inverted concave-like portion 11*j* provided in the space 11*i*; and an opposing guide protrusion 11*k*. Incidentally, in FIG. 8(*b*), the reference numeral 10*j* represents a cutter hole 10*j* opened on the lateral face 10 of the case 1A, and forming the concave-like portion 11*j*. Then, the support rod 47 of the extension rod 4 is disposed on a right side of the concave place 11*c* from the space 11*i*. When the compression spring 5 comes to the urging-force released state (the retracting position of the hook 2) wherein the compression spring 5 has released the urging force as shown in FIG. 7(*c*) from the urging-force accumulated state (the standby position of the hook 2) wherein the compression spring 5 has accumulated the urging force as shown in FIG. 7(*b*), the support rod 47 is moved toward the internal space 16 from the concave place 11*c* together with the extension rod 4.

Incidentally, the retracting device and the retracting main body of the present invention are not limited to each embodiment described hereinabove, and can be further modified or expanded as a reference of each embodiment described hereinabove. As one example, the extension rod is omitted, and the hook is pivotally supported at the end side of the piston rod.

The present application is based on Japanese Patent Application No. 2010-107640 filed on May 7, 2010, and contents thereof are incorporated herein as a reference.

EXPLANATION OF SYMBOLS

1, 1A . . . a case
2 . . . a hook
3 . . . a piston damper
4 . . . an extension rod
5 . . . a compression spring (an urging member)
6, 6A . . . a retracting main body
7 . . . an engaged device
7*a* . . . a protruding member (a protruding portion)
7*b* . . . an attaching base
8 . . . a drawer body (a moving body)
8*a* . . . a back portion
8*b* . . . an upper face
8*c* . . . a lateral face
8*d* . . . a back face
9 . . . a guide rail
10, 11 . . . lateral faces
10*a*, 11*a* . . . inner faces
11*b*, 11*c* . . . concave places
11*d* . . . a back end
10*h*, 11*h* . . . locking portions
11*e*, 11*f* . . . ribs
12 . . . a front end face
13 . . . a back end face
14 . . . an upper face
14*a* . . . a positioning piece portion
15*a* . . . lower face
16 . . . an internal space
17*a*, 17*b* . . . attachment holes
18, 18*a* . . . guide grooves
19, 19*a* . . . guide grooves
20 . . . a connecting groove
21 . . . an engagement hole
22 . . . a concave portion
23 . . . a projecting portion
30 . . . a cylinder
32 . . . a piston rod
35 . . . an extension rod
41 . . . a first rod
45 . . . a second rod
47 . . . a support rod

What is claimed is:

1. A retracting device, comprising:

a retracting main body including a case placed on an enclosure side, a hook comprising an axis portion protruding laterally from the hook, a protrusion situated adjacent to the axis portion and protruding laterally from the hook, and a concave portion, an urging member urging the hook in a longitudinal direction of the case, a braking device, a guide groove formed in the case along the longitudinal direction of the case, and another guide groove formed in the case parallel to the guide groove, wherein the hook, the urging member and the braking device are disposed in the case; and a protruding portion placed on a moving body side, and engaging with and disengaging from the concave portion of the hook in a middle of a movement of a moving body relative to an enclosure, wherein the axis portion is held in the guide groove to slidably move therein, and the hook is switched between a retracting position allowing the moving body to move in an engaged state with the protruding portion, and a standby position prohibiting the moving body to move in a disengaged state, the protrusion is held in the another guide groove to slidably guide the protrusion therein, and switching the hook from the standby position to the retracting position, the braking device includes a piston damper having a cylinder and a piston rod, and either one of the cylinder or the piston rod is fixed in the case, and the other is slidably disposed and the hook is pivotally supported on an end side thereof, and the hook is in the standby position in which the hook is disengaged from the protruding portion in a state wherein the piston rod is entered with respect to the cylinder to reduce a protruding dimension, and is switchable to the retracting position from the standby position when the piston rod increases the protruding dimension relative to the cylinder.

2. A retracting device according to claim 1, wherein the urging member includes a compression spring, and is disposed along the piston damper, and one end is locked on a slidably disposed side among the cylinder and the piston rod, and the other end is immovably engaged.

3. A retracting device according to claim 2, wherein the compression spring is disposed on an outer circumference of the other slidably disposed side among the cylinder and the piston rod.

4. A retracting device according to claim 2, further comprising a guide axis connected to the other slidably disposed side among the cylinder and the piston rod, and disposed approximately parallel to the piston damper, wherein the compression spring is disposed on an outer circumference of the guide axis.

5. A retracting device according to claim 3, wherein the other slidably disposed side is the piston rod among the cylinder and the piston rod, and the piston rod comprises an extension rod connected on a coaxial line.

6. A retracting main body according to claim 1, which is used for the retracting device assisting a moving operation of the moving body relative to the enclosure by an urging force.

7. A retracting main body according to claim 1, further comprising a locking portion formed at a front end of the another guide groove, wherein the protrusion of the hook engages the locking portion when the hook is in the standby position, and the protrusion of the hook moves slidably in the another guide groove when the hook is in the retracting position.

8. A retracting main body according to claim 1, wherein the guide groove extends linearly so that the axis portion moves only linearly, and the hook tilts around the axis portion.

* * * * *